US006718642B2

(12) United States Patent
Collins

(10) Patent No.: US 6,718,642 B2
(45) Date of Patent: Apr. 13, 2004

(54) RABBETING PLANE

(76) Inventor: David Collins, 10179 Brock Rd., Plain City, OH (US) 43064

( * ) Notice: Subject to any disclaimer, the term of this patent is extended or adjusted under 35 U.S.C. 154(b) by 128 days.

(21) Appl. No.: 10/067,057

(22) Filed: Feb. 6, 2002

(65) Prior Publication Data

US 2002/0133956 A1 Sep. 26, 2002

Related U.S. Application Data

(60) Provisional application No. 60/278,068, filed on Mar. 22, 2001.

(51) Int. Cl.[7] ..... B27G 17/02
(52) U.S. Cl. ..... 30/492; 30/478
(58) Field of Search ..... 30/492, 487, 484, 30/478, 479, 480, 485, 486, 490, 491

(56) References Cited

U.S. PATENT DOCUMENTS 99,795 A * 2/1870 Stewart 4,015,649 A * 4/1977 Gilbert

* cited by examiner

*Primary Examiner*—Douglas D Watts
(74) *Attorney, Agent, or Firm*—James R. Eley; Michael A. Forhan

(57) ABSTRACT

A method and apparatus for a blade clamping mechanism in a woodworking plane that allows a plane iron as wide as the plane body itself to be clamped in a wedge shaped slot in the plane body. The slot begins at a point tangent to a waste ejection hole proximate a front area of the plane running diagonally towards the spine of the plane body before looping back short of the spine to return diagonally through the sole forming the mouth together with the waste hole. The loop forms the widest point of the slot, while the tangent forms the narrowest point of the slot. The rear surface of the slot serves as the ramp for the plane iron. The plane iron is clamped by a floating pin mounted in a hole drilled longitudinally through the spine, perpendicular to the ramp, and terminating at an inspection hole. The floating pin is retained between the under side of the plane iron and a conical shaped point of a screw threaded from a back of the plane body diagonally to the floating pin. The pin and screw are viewable through the inspection hole.

20 Claims, 1 Drawing Sheet

RABBETING PLANE

RELATED APPLICATION

This application claims priority under 35 U.S.C. §119(e) on U.S. Provisional Patent Application No. 60/278,068 to Collins, filed Mar. 22, 2001, and entitled "Rabbeting Plane."

BACKGROUND

In the field of woodworking, those skilled in the art of plane making seek to secure the blade of a plane, referred to as a plane iron, as rigidly as possible in order to prevent chatter, achieve smooth cuts, and set and maintain a desired depth of cut. In the simplest construction, the plane iron is held by means of a wedge driven between a forward section of the body and the plane iron, which creates pressure against a ramp. The wedge is positioned into shallow grooves that are cut into a throat and tapered toward a mouth, where the taper is matched to a pitch of the wedge.

In a slightly different design, the plane body utilizes a retaining pin passing transversely through a body of the plane through a throat of the plane body and parallel to a sole of the plane body. A plate, known as a cap iron, pivots against a retaining pin and contacts the plane iron close to a cutting edge at a mouth of the plane body. A screw is positioned opposite the mouth and on the other side of the retaining pin, where the screw is threaded through the cap iron and is turned to create leverage against the plane iron on either side of the pin. Other prior art devices using this design lever the cap iron on the screw fastened into the plane body at the ramp. A cutting depth of the plane iron is adjusted by means of a slot in the plane iron running longitudinally. A hole in the cap iron captures the head of the screw, using it as a fulcrum to lever the plane iron firmly against the ramp. In each of these prior art devices the front and rear sections are integral with sides that encompass the plane iron, which allows it to plane only a portion of the total width of the plane body as it projects through the sole.

Another class of planes, know in the art as rabbeting planes, are designed to cut the entire width of the plane body by means of openings in the sides of the body. The plane iron is then formed with a full width edge that can project past the side openings, but a narrower tang portion is necessary to fit between raised sides, the higher sides being necessary to hold the front and rear portions of the sole in alignment, and the tang necessary for clamping and depth adjustment.

SUMMARY

Various embodiments provide a method and apparatus for a blade clamping mechanism in a woodworking plane, which allows a plane iron as wide as the plane body itself to be clamped in a wedge shaped slot in the plane body. The slot begins at a point tangent to a waste ejection hole at the front of the plane and runs diagonally towards the spine of the plane body, looping back short of the spine and returning diagonally through the sole forming the mouth together with the waste hole. The loop forms the widest point of the slot and the tangent forms the narrowest point of the slot, where the rear surface of the slot serves as the ramp for the plane iron. The plane iron is clamped by a floating pin mounted in a hole drilled longitudinally through the spine, perpendicular to the ramp, and terminating at an inspection hole. The floating pin is retained between the under side of the plane iron and the conical shaped point of a screw threaded from the back of the plane body diagonally to the pin and parallel to the sole. The pin and the screw contact and are viewable through the inspection hole.

In use the blade is adjusted to the desired depth while the pin is loose. As the screw is advanced the pin is tightened against the under side of the blade flexing the blade against the tangent point of the waste hole. Within the confines of the wedge shaped slot as the pin climbs, the conical tip of the screw at a compounded ratio thereby places sufficient clamping pressure at the mouth of the plane.

Other embodiments provide a rabbeting plane comprising a plane body and a plane iron. The rabbeting plane further comprises a slot extending partially through the plane body into which the plane iron is received. The rabbeting plane further comprises a first hole extending from an edge of the plane body to an interaction area and a second hole extending from the interaction area to the slot. Finally, the rabbeting plane further comprises a pin extending from the interaction area to the slot through the second hole positioned so as to engage the plane iron and a screw extending from outside the plane body to the interaction area through the first hole, an end of the screw interacting with an end of the pin such that the pin secures the plane iron to the plane body.

Other aspects of the embodiments are numerous. The instant blades do not require tangs and may be made the full width of the plane body. This enables planes to be formed much narrower than other planes, which are then able to cut in tighter spaces. As the plane iron cuts full width, they may be formed and ground to cut many different profiles. It is easier to manufacture these planes in smaller sizes for fine detail cutting and miniature work. The clamping force is compounded and focused at the mouth of the ramp and blades do not chatter due to looseness at the mouth.

BRIEF DESCRIPTION OF THE DRAWINGS

Further features of the embodiments will become apparent to those skilled in the art to which the embodiments relate from reading the following specification and claims, with reference to the accompanying drawings, in which:

DESCRIPTION OF THE PREFERRED EMBODIMENT(S)

Figure 1:
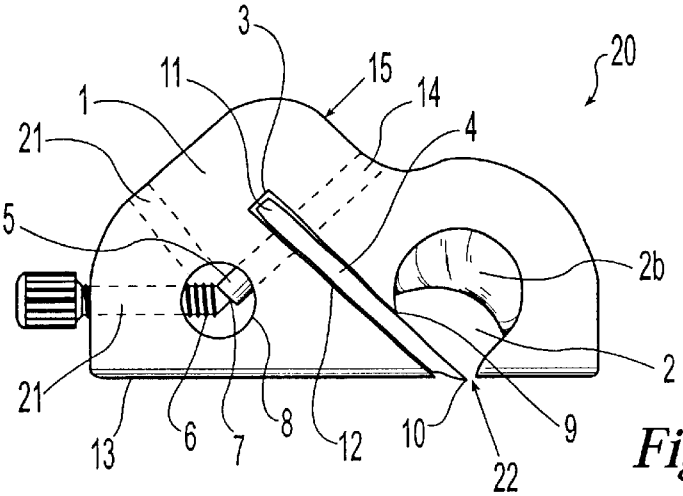
FIG. 1 is an elevational view of an embodiment.

Referring to the drawings in detail, a rabbeting plane 20, according to various embodiments, comprises a plane body 1 with a waste ejection hole 2, which is proximate a front section of the plane body 1, and a wedge shaped slot 3. The slot 3 assists in aligning and supporting a plane iron 4, which is flexed within the slot 3 by the force of a floating pin 5. The force is adjusted by turning a screw 6 with a cone tip 7 through a hole 21. In various embodiments, it is contemplated that a longitudinal axis of the hole 21 may be formed at varying angles with respect to a longitudinal axis of the pin 5, where the angles may range from about 90°– about 180°. The contact point 7 of screw 6 interacts with the pin 5 at an interaction area that may be viewable in a hole 8, which may be an inspection hole. A hole 14 passes through a spine 15 of the plane body 1 perpendicularly to a ramp 12 in the slot 3, where the hole 14 allows installation and removal of the pin 5 when the plane iron 4 is removed.

When the screw 6 is advanced the pin 5 is also advanced at a reduced ratio, where the pin 5 presses an underside of the plane iron 4 at a butt end 11. The plane iron 4 is thus leveraged against a tangent point 9 of the waste ejecting hole 2 to transfer pressure against an opening 22 at a base of the ramp 12. The cutting edge 10 of the plane iron 4 is positioned above or below a sole 13 of the plane body 1 by loosening the screw 6 and moving the plane iron 4 with a user's fingers.

Figure 2:
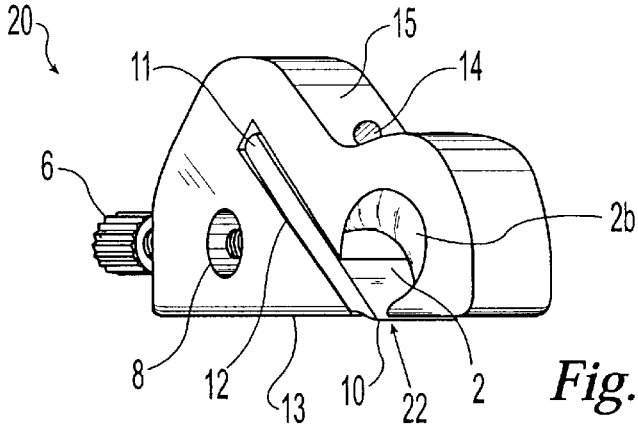
FIG. 2 is a front perspective view of an embodiment.
Figure 3A:
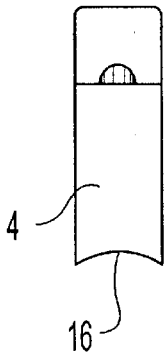
FIGS. 3A–D are front elevational views of different blade profiles according several embodiments.
Figure 3B:
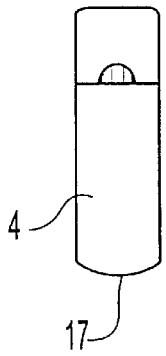
Figure 3C:
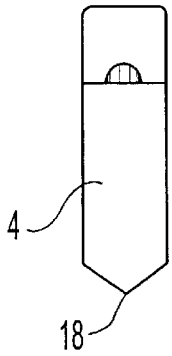
Figure 3D:
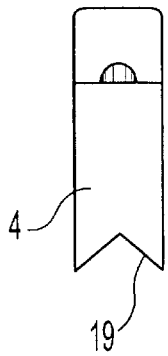

One embodiment of a profile of the plane iron 4 is shown in FIGS. 1 and 2, which may be a flat bottom plane profile. Other embodiments of profiles of the plane iron 4 are shown in FIGS. 3A–3D. FIG. 3A shows a concave plane iron profile 16, which may cut or trim beads, FIG. 3B shows a convex plane iron profile 17, which may be used to cut or trim coves, FIG. 3C shows a v-shaped plane iron profile 18, which may be used to cut or trim V grooves or side rabbets, and FIG. 3D shows an upside down v-shaped profile 19, which may be used to cut or trim chamfers.

Turning again to FIG. 2, in other embodiments the waste ejecting hole 2 may be fitted with an direction device 2*b* that causes wood shavings (not shown) to curl up and migrate out a desired side of the waste ejecting hole 2. In this arrangement, waste shavings may be more easily removed during use of the rabbeting plane 20. The direction device 2*b* may be mounted from either side of waste ejecting hole 2, thus directing the shavings toward either the left or right side of the waste ejecting hole 2, as desired.

The embodiments have been described in detail with respect to specific embodiments thereof, but it will be apparent that numerous variations and modifications are possible without departing from the spirit and scope of the embodiments as defined by the following claims.

What is claimed is:

1. A rabbeting plane, comprising:

a plane body;

a plane iron;

a slot extending partially through the plane body into which the plane iron is received;

a first hole extending from an edge of the plane body to an interaction area within the plane body;

a second hole extending at least from the interaction area to the slot;

a pin extending from the interaction area to the slot through the second hole positioned so as to engage the plane iron; and a screw extending from outside the plane body to the interaction area through the first hole, an end of the screw interacting with an end of the pin such that the pin secures the plane iron to the plane body.

2. The rabbeting plane of claim 1, wherein a longitudinal axis of the pin and a longitudinal axis of the screw are positioned at an obtuse angle with respect to each other.

3. The rabbeting plane of claim 2, wherein a longitudinal axis of the pin and a longitudinal axis of the screw are positioned perpendicular to each other.

4. The rabbeting plane of claim 1, wherein the plane iron has a concave end profile.

5. The rabbeting plane of claim 1, wherein the plane iron has a convex end profile.

6. The rabbeting plane of claim 1, wherein the plane iron has a v-shaped end profile.

7. The rabbeting plane of claim 1, wherein the plane iron has an inverted v-shaped end profile.

8. The rabbeting plane of claim 1, wherein the slot is wedge shaped.

9. The rabbeting plane of claim 1, further comprising:

a waste ejection hole; and a direction device coupled proximate the waste ejection hole.

10. An apparatus for a blade clamping mechanism in a woodworking plane, the apparatus comprising:

a plane body;

a wedge shaped slot in the plane body, said slot having two sides and a closed end and extending only partially through the plane body; and a plane iron clamped in the wedge shaped slot.

11. The apparatus of claim 10, further comprising:

a spine of the plane body;

a sole of the plane body; and a waste ejection hole positioned proximate a front of the plane body;

wherein the slot begins at a point tangent to the waste ejection hole running diagonally towards the spine of the plane body looping back short of the spine to return diagonally through the sole, wherein the slot together with the waste ejection hole form a mouth of the plane body.

12. The apparatus of claim 11, wherein:

the loop forms the widest point of the slot and the tangent forms the narrowest point of the slot; and a rear surface of the slot serves as a ramp for the plane iron.

13. The apparatus of claim 10, further comprising:

a floating pin mounted in a hole drilled longitudinally through a spine of the plane body, the hole being perpendicular to a ramp in the slot and terminating at an Inspection hole; and a screw with a conical shaped point, the screw being threaded from a back section of the plane body at an angle with respect to the pin;

wherein the plane iron is clamped by means of the floating pin and the floating pin is retained between an under side of the plane iron and the conical shaped point of the screw.

14. The apparatus of claim 13, wherein the angle is an obtuse angle.

15. The apparatus of claim 13, wherein the angle is about 90°.

16. The apparatus of claim 10, wherein the plane iron is substantially a same width as the plane body.

17. The apparatus of claim 10, further comprising:

a waste ejection hole proximate a front area of the plane body; and a direction device coupled adjacent the waste ejection hole.

18. A method for making a rabbeting plane, comprising the steps of:

providing a plane body;

providing a plane iron;

receiving the plane iron in a slot extending partially through the plane body;

forming a first hole extending from an edge of the plane body to an interaction area within the plane body;

forming a second hole extending at least from the interaction area to the slot;

engaging the plane iron with a pin extending from the interaction area to the slot through the second hole;

passing a screw from outside the plane body to the interaction area through the first hole; and interacting an end of the screw with an end of the pin to secure the plane iron to the plane body.

19. The method of claim 18, further comprising the steps of forming a longitudinal axis of the pin and forming a longitudinal axis of the screw, such that they are positioned at an obtuse angle with respect to each other.

20. The rabbeting plane of claim 18, further comprising the steps of forming a longitudinal axis of the pin and forming a longitudinal axis of the screw, such that they are positioned perpendicular to each other.

* * * * *